United States Patent [19]

Hyman et al.

[11] 4,363,181

[45] * Dec. 14, 1982

[54] ELECTRONIC MUSICAL MOBILE

[76] Inventors: Gregory E. Hyman, 12 Chester Pl., Bronxville, N.Y. 10708; Lawrence J. Greenberg, 64 Mountain Ave., Larchmont, N.Y. 10538

[ * ] Notice: The portion of the term of this patent subsequent to Jun. 17, 1997, has been disclaimed.

[21] Appl. No.: 159,519

[22] Filed: Jun. 16, 1980

Related U.S. Application Data

[63] Continuation-in-part of Ser. No. 929,530, Jul. 31, 1978, Pat. No. 4,207,696.

[51] Int. Cl.[3] ..... G09F 11/00; A63H 33/26; A63H 13/20

[52] U.S. Cl. ..... 40/466; 40/455; 40/473; 46/232; 46/269; 272/31 R

[58] Field of Search ..... 40/473, 457, 463, 466, 40/474, 455; 272/31 R; 46/232, 269, 47

[56] References Cited

U.S. PATENT DOCUMENTS

| | | | |
|---|---|---|---|
| 1,681,310 | 8/1928 | Reiner | 272/31 R |
| 1,913,150 | 6/1933 | Atwater | 40/473 |
| 2,387,533 | 10/1945 | Schmucker | 310/117 |
| 2,673,087 | 3/1954 | Bacon | 272/31 R |
| 2,828,963 | 4/1958 | Steiner | 272/31 R |
| 3,060,628 | 10/1962 | Palmer | 46/59 |
| 3,533,489 | 10/1970 | Dinnerstein | 40/466 |
| 3,927,482 | 12/1975 | Marcus | 40/455 |
| 3,983,647 | 10/1976 | Stubbmann | 40/466 |
| 4,207,696 | 6/1980 | Hyman et al. | 40/473 |

*Primary Examiner*—Paul J. Hirsch
*Assistant Examiner*—Michael J. Foycik
*Attorney, Agent, or Firm*—Henry Sternberg

[57] ABSTRACT

A mobile is rotated by an energy storage device to which energy is periodically transferred by a motor which is in turn controlled by an electronic circuit. The electronic circuit simultaneously controls a loudspeaker to produce a wide variety of music with variations in tune, tonal quality, key, tempo, and loudness.

17 Claims, 4 Drawing Figures

11
10
12
13
14

10
12
13
14

2
19
1
21
18
22
23
3
20
4
24
25
26
27
5

ELECTRONIC MUSICAL MOBILE

CROSS REFERENCE TO RELATED CASES

This case is a continuation-in-part of Ser. No. 929,530, filed 7/31/78, now 4,207,696, issued June 17,1980.

BACKGROUND OF THE INVENTION

The present invention relates to a toy, more particularly a motor driven musical mobile.

Prior to the present invention, it was known to have an electricly driven mobile in combination with a music box. For example, U.S. Pat. No. 3,927,482 discloses such a mobile wherein an electric motor powered by household current rotates a mobile while simultaneouslly driving a conventional mechanical music box. The control of the music box and rotation of the mobile is by a simple on-off switch. In order for the mobile to cease being driven and the music box to cease playing, the switch must be manually turned off.

In U.S. Pat. No. 4,207,696, there is disclosed a sound actuated mobile which is driven by a battery operated motor in response to sounds made by the child in the crib. The mobile conists of a motor connected to an energy storage means such as a cord, spring or wire. The motor is activated for only short periods of time in order for it to transfer energy to the energy storage means. The energy storage means then releases its energy causing rotation of the mobile to which it is connected. Such construction permits intermittent operation of the motor thereby substantially extending the useful life of the battery which powers the motor.

SUMMARY OF THE INVENTION

In accordance with the present invention, a mobile is rotated by a motor which is intermittently operated in response to a control circuit. The control circuit may be manually set to operate for one of a plurality of predetermined periods of time such as 10, 20 or 30 minutes, during which time the circuit will simultaneously intermittently activate the motor and produce a substantially continuous series of musical tunes for the entertainment of the child. The operator of the device, when making the initial slection of time, also has some control over the selection of the tunes, the tempo of the tunes, the note decay time of the sound (i.e. tonal quality) and the amplitude or loudness of the sound. In addition, the circuit may be automatically repeat selected portions of tunes, make tempo changes when a tune is played for a second or third time, make note decay-time changes, make key shifts and produce wait or silent periods between selections.

DESCRIPTION OF THE PREFERRED EMBODIMENT

Figures 1, 2:
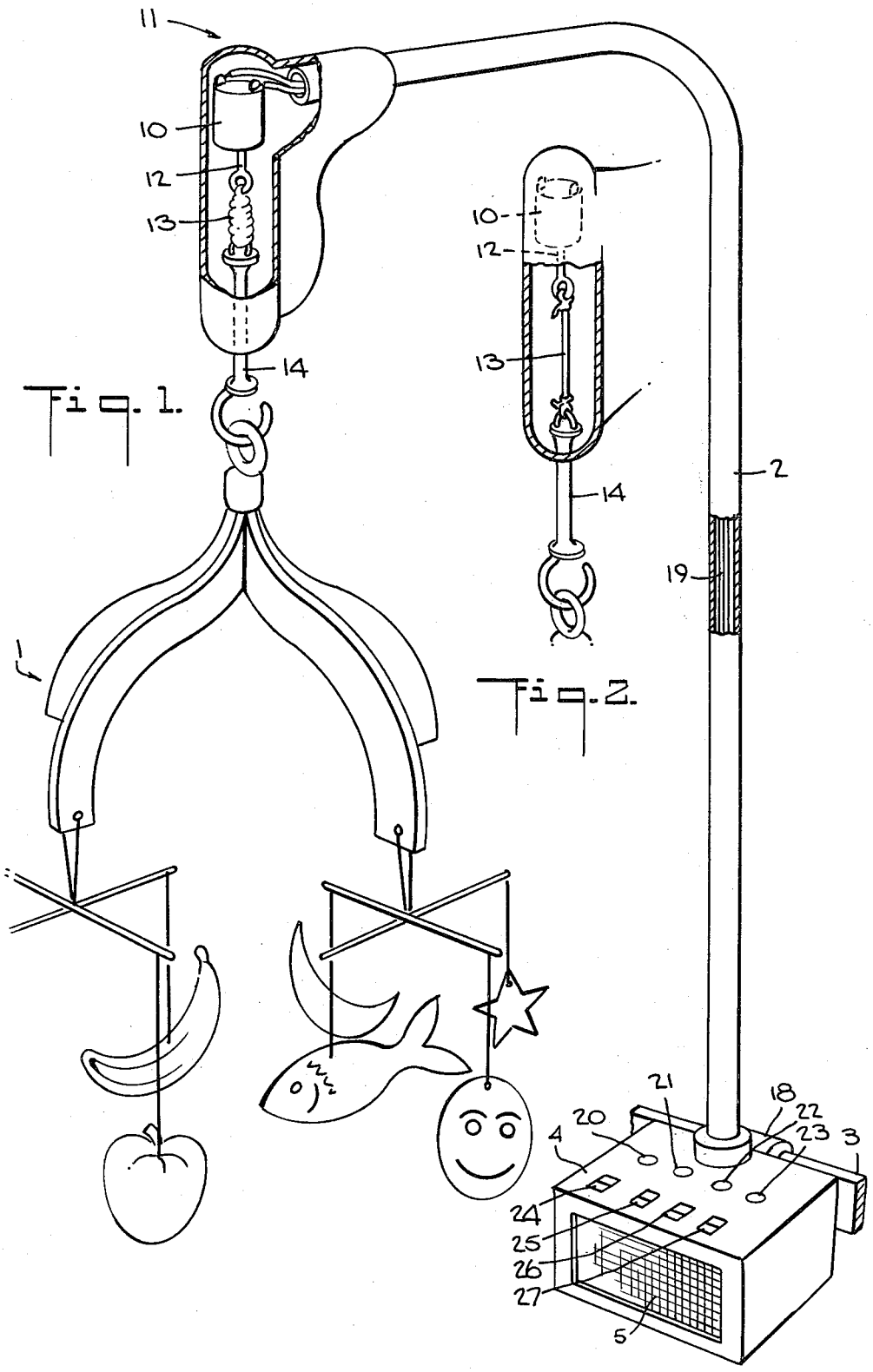
FIG. 1 is a perspective partly cut-away view of a mobile according to the preferred embodiment of the present invention, mounted on a crib rail.
FIG. 2 is an enlarged, partly cut away, side view of the drive means according to the preferred embodiment of the present invention.

Referring to the preferred embodiment of the present invention as shown in FIGS. 1–2, a free-hanging mobile element 1 is suspended by a tubular L-shaped support 2 mounted on control housing 4. Control housing 4 is detachably mounted on crib rail 3 by means of bracket 18. The motion of the mobile 1 and the production of the music is controlled by control circuit 8 mounted in housing 4 and the switches 20 through 27 positioned on the upper surface of housing 4.

A vertical cylindrical housing 11 is mounted at the cantilevered free end of support 2. Rotation of the mobile 1 is accomplished by periodically energizing of an electric motor 10 located in housing 11. The electrical circuitry 8 is connected to the motor 10 by wires 19 mounted within support 2. The mobile 1 is suspended from the shaft 12 of motor 10 by way of a cord 13 attached at one of its ends to the mobile 1, via a connector 14 and at its other end to the shaft 12.

Mounted in the housing 4 is a loudspeaker 5, batteries 6, and the control circuit 8. During operation of the mobile 1, control switches 24–27, and loudspeaker 5, cooperate to produce a wide variety of music with variations in tune, tonal quality, key, tempo and loudness.

Figure 3:
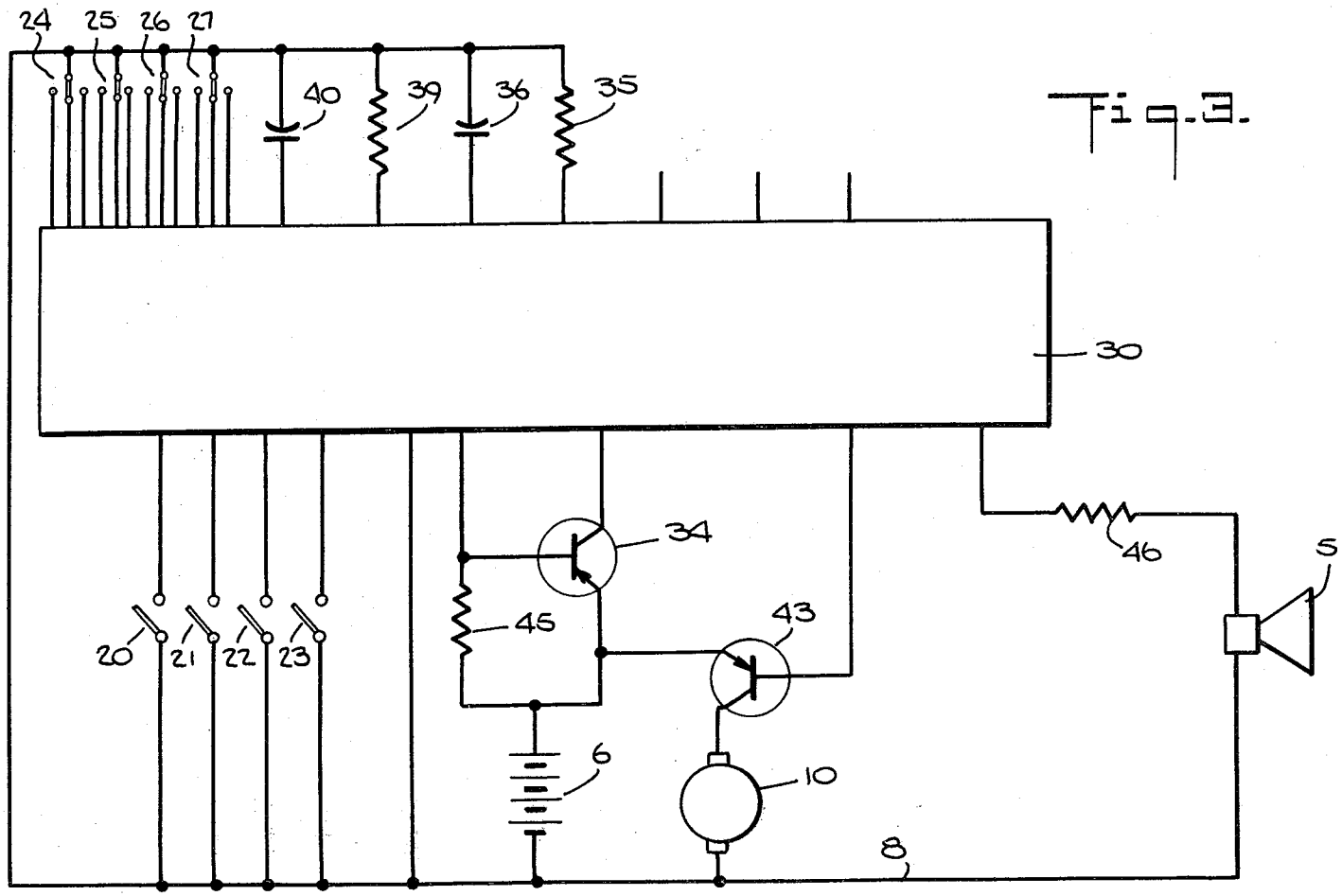
FIG. 3 is a partial circuit diagram showing the external connections to an integrated circuit forming part of a typical electronic circuit for use in an apparatus according to the present invention to control the rotation of the mobile and the production of music.
Figure 4:
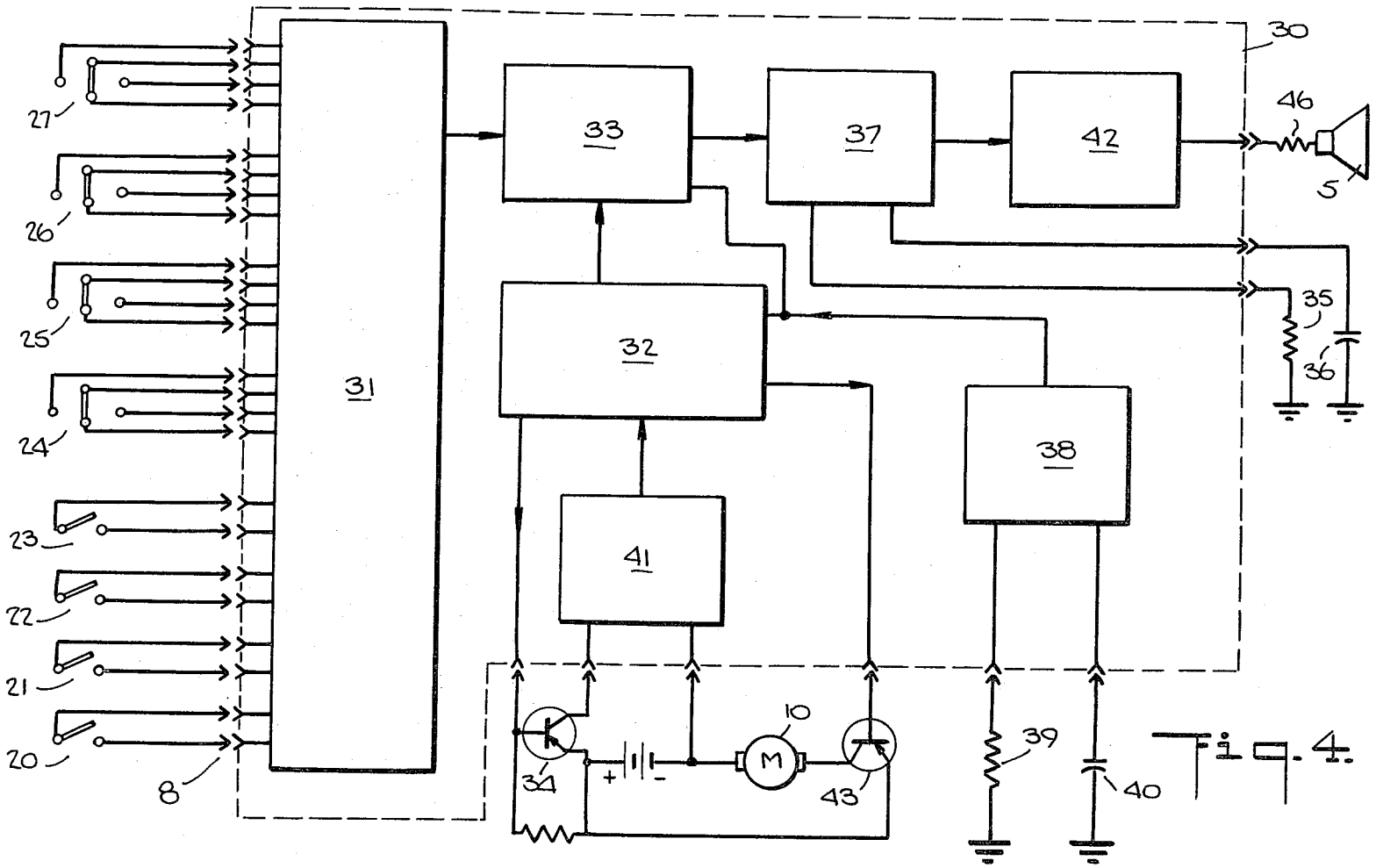
FIG. 4 is a block diagram of the operation of said integrated circuit and its connections to certain circuit elements external to the integrated circuit.

A partial schematic diagram of a typical electronic circuit 8 in accordance with the present invention is shown in FIG. 3 and a block diagram showing the various functional elements of the integrated circuit 30 with their attachment to various elements external of the integrated circuit 30 is shown in FIG. 4.

Commencement of an operating cycle occurs when one of three momentary pushbuttons 20–22 is pushed in and thereafter released. Each pushbutton 20–22 corresponds to a different time length of operation for the cycle. Commencement of an operating cycle activates the timing circuit or timer 32 which controls the duration of the operating cycle. For example, pushbutton 20 might correspond to a 10 minute cycle, pushbutton 21 to a 20 minute cycle and pushbutton 22 to a 30 minute cycle. At the end of the chosen cycle the apparatus automatically deactivates. Each of the pushbuttons 20, 21, 22 sets the circuit timer 32 for the selected operating period, maintaining the device in operation for the allotted time. At the end of the cycle, timer 32 is automatically reset and a new cycle may be initiated by again pushing one of the pushbuttons 20–22. In addition, there is a fourth momentary pushbutton 23 which may be pushed before a cycle is completed. Upon being pushed, pushbutton 23 terminates the operating cycle and resets the timer 32. Thus the activation of one of the switches 20, 21 and 22 activates the control circuit 8 until either the timing cycle is completed by timer 32 or pushbutton 23 is pressed whichever event first occurs.

Upon initiation of a cycle two events occur: (1) rotation of the mobile 1; and (2) the production of music.

Rotation of the mobile 1 is accomplished by motor 10 cooperating with an energy storage means 13. When the motor is energized, motor shaft 12 rotates causing the cord 13 or other energy storage means to be wound. Cord 13 may be, for example, a strand of hemp cord having a length of approximately 4 inches and a diameter of approximately 0.012 to 0.015 inches. The cord 13 is contained within the housing 11 so that it is not accessible. As seen in FIG. 1, when the cord 13 id fully wound, connector 14 will be drawn at least partially into the housing 11. After the cord 13 is wound to the extent that the motor 10 stalls, the control circuit 8 cuts off substantially all current to the motor 10. In the preferred embodiment, this occurs approximately one second after energizing of the motor 10. The stored energy in the wound up cord 13 causes the mobile 1 to rotate until the cord 13 is completely unwound as illustrated in FIG. 2. In the preferred embodiment, this takes approximately 90 seconds. During the operating cycle, the control circuit 8 will periodically activate the motor 10. This will result in either continuous or intermittent rotation of the mobile 1 depending on the time period between consecutive activations of motor 10.

During each such cycle, a musical signal is electronically generated by control circuit 8 for broadcast by loudspeaker 5 to the occupant of the crib. The content of the music can in part be controlled by four 3-way switches 24, 25, 26 and 27 mounted on top of housing 4. Switch 24 acts as a note-decay time-selection switch. This switch allows the listener a range of musical voicing. For example, a short note decay time is associated with a banjo sound while a long decay time gives a bell-like chime effect. In the preferred embodiment there are available three decay times: short, medium and long. Switch 24 may be a three position slide switch, a stepper pushbutton switch or other suitable switching means.

Switch 25, preferably a three position slide switch, controls the tempo at which the tunes are played.

Switch 26 is a tune selection switch. As is more fully explained below, control circuit 8 has a plurality of tunes programmed into its memory. Using the three position slide switch 26 one can select the first half, second half or both halves of the programmed material to be played. The position of the slide switch would indicate to the user the mode that was last selected.

Switch 27 is for controlling the volume or loudness of music. Switch 27 may be a slide control or a stepper pushbutton which can be used to increase intensity of sound, decrease intensity of sound or turn off the sound completely without affecting rotation of the mobile 1.

Additional variables such as key shifts and the addition of wait periods or silences between tunes may be controlled by the addition of switching and circuitry (not shown) to so control the functions.

In addition to the direct control of the sound by means of switches 24–27, it is desirable to have tone modifiers built into the logic circuitry of control circuit 8 in order to make available what appears to the Listener to be a larger repertoire of somgs without significantly increasing the memory capacity. Thus, control circuit 8 preferably includes logic elements for the repeat of selected sections of a tune or tunes, tempo changes, particularly when a tune is being played a second or third time, decay time changes, particularly during a second or third playing, key shifts to move the tone up or down during the playing of a tune or in repetitions of a tune, and waits consisting of silent periods between consecutive tunes.

Activation of one of the pushbuttons 20, 21 or 22 sends a signal to integrated circuit 30 which is part of control circuit 8 by electrically connecting battery 6 to the input command processing and logic portion 31 of integrated circuit 30. This signal acts to set and initiate operation of timer 32 for the period of time selected. The timer 32 controls the operation of transistor 34 in which in turn acts to control receipt of power by transistor 43 and integrated circuit 30, i.e., controls the activation and deactivation of control circuit 8. As previously noted, the operation of the motor 10 winding the cord 13 or other energy storage means is intermittent. The timing of such intermittent operation is controlled by timer 32 through transistor 43 positioned externally of integrated circuit 30. The timing of such intermittent operation is preferably selected to provide continuous rotation of mobile 1. Pushbutton 23 produces a signal to the input command processing logic circuit 31 which resets timer 32, shutting off the power to the entire system through transistor 34, preventing further operation of the motor 10 and terminating playing of the music. Integrated circuit 30, has programmed into its memory a number of tunes which are played in sequence throughout the timing cycle controlled by timer 32. Timer 32 may, if desired, be designed to provide periods of silence or waits between tunes.

As noted, the selection of tunes and the quality of sound may be modified during a cycle by operation of control circuit 8 so that the music does not become monotonous to the child even though groups of the same tunes are repeated throughout the cycle. Such changes may be controlled automatically within the control circuit 8 by preprogrammed patterns in the memory 33.

The user of the apparatus can however also manually control modifications of the music. Thus, switch 24 may be used to control note decay-time through the input command processing and logic circuit 31 i.e. the selection of one of three positions in switch 24 will act to set the note decay time control 37. The note decay time control is initially set by resistor 35 and capacitor 36 external to the integrated circuit 30. While switch 24 is shown operating through input command processing and logic circuit 31, it may alternatively be used to directly vary the values of resistor 35 and capacitor 36.

Switch 25 acts through the input command processing logic circuit 31 to change the tempo of the music signal. Switch 26, through input command processing and logic 31, acts to control tune selection from memory 33 for reproduction. Switch 27, through input command processing and logic 31, acts to vary the overall intensity of the signal by controlling the audio amplifier 42. Audio amplifier 42 amplifies the audio signal and drives loudspeaker 5.

Main oscilator 38 acts as a reference for the timer 32 and the musical note generation and memory 33. Main oscilator 38 has its frequency set by resistors 39 and capacitor 40. The integrated circuit 30 also contains a power supply regulator 41.

Thus the internal circuitry of the integrated circuit 30 is made up of elements that process the input command, address the memory, cause the memory to execute the program that has been accessed and cause the program information to control output circuitry that directs signals to the outside of the integrated circuit 30. These signals of course act to control motor 10, and to generate music. The external components that control the operation of the integrated circuit 30 include the battery 6, resistor 39 and capacitor 40 which control the reference voltage of the main oscilator, resistor 35 and capacitor 36 which controls the note decay time circuit 37, transistor 34 in combination with resistor 45 which acts to turn the control circuit 8 on or off, transistor 43 which acts to periodically activate the motor 10 to intermittently transfer energy to the energy storage means 13 which rotates the mobile 1, and resistor 46 in combination with the speaker 5 which acts to produce the music. The actual design of the integrated circuit 30 so as to perform the functions thereof specified herein is well within the routine capability of persons generally skilled in the art of integrated circuit design and does not require any inventive skills.

Thus, according to this invention, both the timing sequence of the intermittent energization of the motor 10 and the timing of the periods of music generation are accomplished by timer means 32.

The battery life of battery 6 is substantially enhanced as a result of a number of factors. Among these are the very short intermittent actuations of the motor 10, the very low starting torque required of the motor due to the low resistance to winding of the cord 13 at the time winding of the cord 13 is initiated. As winding of the cord 13 continues, during the approximately one second actuation of motor 10, the wound cord 13 begins to overcome the inertia of mobile 1 and begins to rotate the mobile. If desired, control circuit 8 may be programmed to interrupt the music during the short periods of actuation of the motor 10 to eventually enhance battery life. It will be noted however that due to the construction described herein the rotation of the mobile may be continuous despite the only intermittent and widely spaced spurts of energization of electric drive motor 10 since the energy storage means will assure continued rotation of the mobile long after each operation of motor 10.

While the device herein described constitutes a preferred embodiment of the invention, it is to be understood that the invention is not limited to the precise device, and that changes may be made therein without departing from the scope of the invention.

What is claimed is:

1. A musical mobile comprising: a rotatable mobile, electric drive means, power transmitting means including energy storage means operatively connecting said mobile to said electric drive means for rotating said mobile in response to release of energy previously stored in said energy storage means and a control circuit means operatively connected to said electric drive means for peroidically activating said electric drive means during the operating cycle of said control means and for simultaneously electronically generating music during said operating cycle, said control circuit means having manual control means for selecting the duration of said operating cycle.

2. A musical mobile in accordance with claim 1 including manual control means for stopping the operating cycle before completion of said cycle.

3. A musical mobile in accordance with claim 1 including manual control means for varying the note decay time of the music generated by the control circuit.

4. A musical mobile in accordance with claim 1 wherein the control circuit means automatically varies its note decay-time during portions of its operating cycle.

5. A musical mobile in accordance with claim 1 including manual control means for varying the tempo of the music generated by the control circuit means.

6. A musical mobile in accordance with claim 1 wherein the control circuit means automatically varies the tempo of the music during portions of an operating cycle.

7. A musical mobile in accordance with claim 1 including manual control means for varying the tunes of music generated by the control circuit means.

8. A musical mobile in accordance with claim 1 wherein the control circuit means automatically varies the selection of tunes during portions of the operating cycle.

9. A musical mobile in accordance with claim 1 including manual control means for varying the loudness of the music produced by the control circuit means.

10. A musical mobile in accordance with claim 1 wherein the control circuit means is capable of automatically varying the key in which the music is played during portions of the operating cycle.

11. A musical mobile in accordance with claim 1 including manual control means for varying the key of the music generated by the control circuit means.

12. An apparatus adapted to rotate a mobile, comprising: electric motor drive means adapted to be operatively connected to a mobile for rotating said mobile, energy storage means operatively connected to said electric motor drive means and to said mobile for rotating the mobile in response to release of energy previously stored in the energy storage means by the electric motor means, and control circuit means for intermittently actuating said electric motor drive means for a desired period of time after the energy storage means has been at least partially depleted of stored energy.

13. The apparatus of claim 12 wherein said control circuit means includes an electronic timer for actuating said electric motor drive means intermittently at intervals corresponding to predetermined depletion of the energy stored in said energy storage device so as to assure continuous rotation of said mobile.

14. The apparatus of claim 13 wherein the control circuit is energized by an electric battery.

15. The apparatus of claim 12 wherein energy storage means is a cord which is wound by and in response to actuation of said electric motor drive means and which in turn urges the mobile to rotate in the same direction as said motor after deactivation of said motor.

16. The apparatus of claim 15 wherein said control circuit means includes means for generating electronic music.

17. The apparatus of claim 16, wherein said control circuit means ceases generating music during the time said electric motor drive means is actuated.

* * * * *